United States Patent [19]

Demonbreun

[11] Patent Number: 4,641,507

[45] Date of Patent: Feb. 10, 1987

[54] LOCK MECHANISM

[75] Inventor: Betty J. Demonbreun, Memphis, Tenn.

[73] Assignees: W. Stuart McCloy, Jr.; W. Stuart McCloy, Sr., both of Memphis, Tenn.

[21] Appl. No.: 577,517

[22] Filed: Feb. 6, 1984

[51] Int. Cl.[4] ..... E05B 35/12; E05G 3/00

[52] U.S. Cl. ..... 70/339; 70/DIG. 63; 109/35; 109/57; 292/210

[58] Field of Search ..... 109/35, 57, 59 R, 59 T; 70/84, 339, DIG. 63, 364 R; 292/108, 210

[56] References Cited

U.S. PATENT DOCUMENTS

| | | | |
|---|---|---|---|
| 853,485 | 5/1907 | Townsend | 70/339 |
| 2,762,216 | 9/1956 | Wasson | 70/339 |
| 2,872,241 | 2/1959 | Shelden | 292/210 |
| 3,154,938 | 11/1964 | Cohen | 70/339 |
| 3,916,657 | 11/1975 | Steinbach | 70/339 |
| 4,033,157 | 7/1977 | Williams | 70/DIG. 63 |
| 4,332,153 | 6/1982 | Miles | 70/339 |

FOREIGN PATENT DOCUMENTS

| | | | |
|---|---|---|---|
| 87047 | 3/1895 | Fed. Rep. of Germany | 292/210 |
| 2536862 | 3/1977 | Fed. Rep. of Germany | 70/364 R |
| 1510060 | 12/1967 | France | 70/339 |

*Primary Examiner*—Gary L. Smith
*Assistant Examiner*—Neill Wilson
*Attorney, Agent, or Firm*—Walker & McKenzie

[57] ABSTRACT

A protection system for preventing unauthorized entry through a door member. An electrically charged cover is placed over the door member for electrically shocking anyone who attempts unauthorized entry therethrough. An electrical insulator inner cover is placed between the door member and the electrically charged cover. A first lock is provided to lock the door member in a closed position. A second lock is provided to lock the first lock in a locked position.

2 Claims, 10 Drawing Figures

LOCK MECHANISM

BACKGROUND OF THE INVENTION

1. Field of the Invention:

The present invention relates to protection means for preventing unauthorized entry through doors.

2. Description of the Prior Art:

Heretofore, various means have been developed for preventing or hindering access through a door or the like. See, for example, Zell, U.S. Pat. No. 79,047; Whitney, U.S. Pat. No. 158,876; Kern, U.S. Pat. No. 438,626; Dengler, U.S. Pat. No. 817,962; Bumpass, U.S. Pat. No. 1,413,573; Gettell, U.S. Pat. No. 1,535,770; Irwin, U.S. Pat. No. 1,792,537; Drenthe, U.S. Pat. No. 1,984,012; Sullivan, U.S. Pat. No. 2,018,098; Davis, U.S. Pat. No. 2,203,675; Lopina, U.S. Pat. No. 3,391,512; Arai, U.S. Pat. No. 3,863,762; and Dumortier, U.S. Pat. No. 4,175,781. None of the above patents disclose or suggest the present invention.

SUMMARY OF THE INVENTION

The present invention is directed toward providing an improved means for preventing unauthorized entry through a door member.

A first embodiment of the protector means of the present invention may include an electrically charged cover means for completely covering the door member and for electrically shocking anyone who attempts unauthorized entry through the door member; and an electrical insulator inner cover means for placement between the electrically charged cover means and the door member and for electrically insulating the door member from the electrically charged cover means.

A second embodiment of the protector means of the present invention may include a first lock means movably associated with the door jamb to which the door member is movably associated and for movement between a locked position in which the door member is locked in a closed position and an unlocked position; and a second lock means movably associated with the door jamb for movement between a locked position in which the first lock means is locked in the locked position and an unlocked position.

DESCRIPTION OF THE PREFERRED EMBODIMENTS

Figure 1:
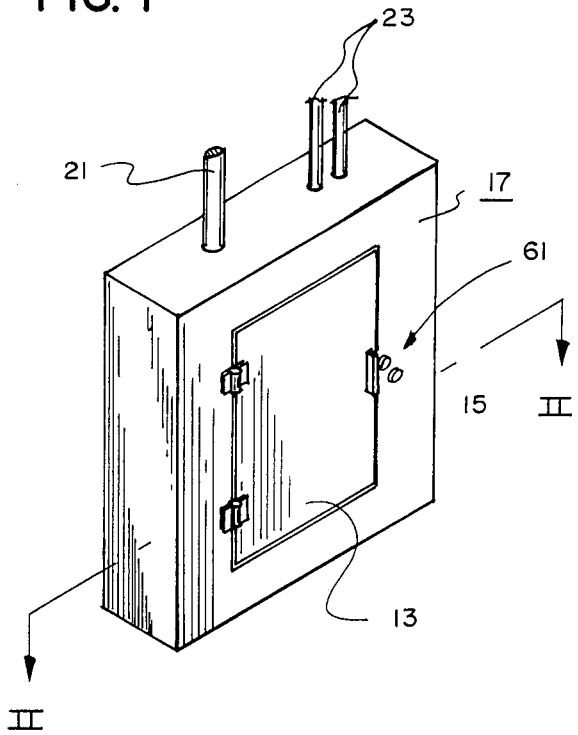
FIG. 1 is a perspective view of a security box means including a lock means of the protection means of the present invention.
Figure 2:
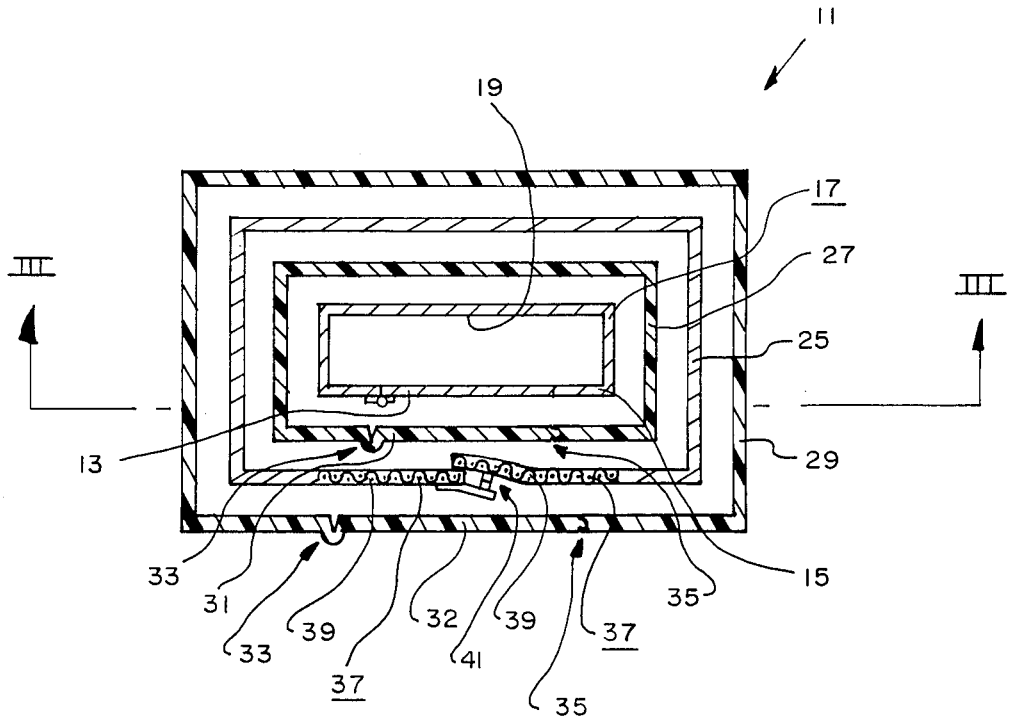
FIG. 2 is a sectional view substantially as taken on line II—II of FIG. 1 but showing the security box means enclosed by various cover means of the protection means of the present invention.
Figure 3:
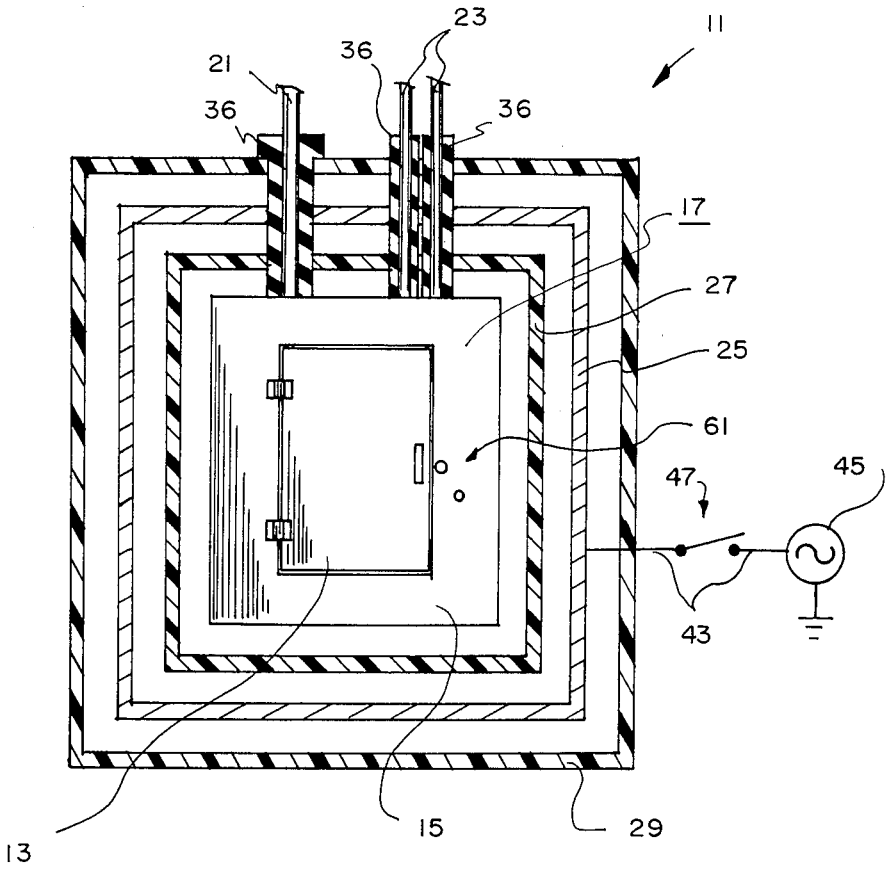
FIG. 3 is a sectional view substantially as taken on line III—III of FIG. 2 with various electrical circuitry thereof shown schematically.

The protector means 11 of the present invention is for preventing unauthorized entry through a door member 13 of the type movably associated with a door jamb 15 (see, in general, FIGS. 1–3). The door member 13 may be part of a security box means 17 having an interior 19 for containing means to which it is desired to restrict access to. For example, the security box means 17 may consist of a typical electrical power box for enclosing the main electrical power switches for a house, factory or the like. Thus, at least one electrical supply line 21 and at least one electrical outlet line 23 may communicate with the interior 19 of the security box means 17. The security box means 17 may be of typical metal construction and the door member 13 may be pivotally attached to the front of the box means 17 with the door jamb 15 defining an adjacent portion of the front of the box means 17. It should be noted that the box means 17 may include an adjacent pair of hingeably mounted door members (not shown) wherein one of the door members may define the door member 13 and the other of the door members may define the door jamb 15 in a manner which should now be apparent to those skilled in the art.

The protector means 11 may include an electrically charged cover means 25 for completely covering the door member 13 and for electrically shocking anyone who attempts unauthorized entry through the door member 13; and includes an electrical insulator inner cover means 27 for placement between the electrically charged cover means 25 and the door member 13 and for electrically insulating the door member 13 from the electrically charged cover means 25 (see, in general, FIGS. 2 and 3). An electrical insulator outer cover means 29 is preferably provided for placement over the electrically charged cover means 25 and for preventing inadvertent contact with the electrically charged cover means 25 (see, in general, FIGS. 2 and 3). The inner cover means 27 preferably defines a box for completely enclosing the security box means 17. The electrically charged cover means 25 also preferably defines a box for completely enclosing the inner cover means 27 and the security box means 17. Likewise, the outer cover means 29 preferably defines a box for completely enclosing the electrically charged cover means 25, the inner cover means 27 and the security box means 17.

The inner and outer cover means 27, 29 may be constructed of any electrically non-conductive material such as plastic or the like. The inner cover means 27 includes a door member 31 for allowing authorized access to the door member 13 of the security box means 17. The outer cover means 29 includes a door member 32 for allowing authorized access to the electrically charged cover means 25. The door members 31, 32 may be of any typical construction apparent to those skilled in the art. Thus, for example, the door members 31, 32 may be integrally constructed with the remainder of the respective cover means 27, 29 out of an electrically non-conductive material such as plastic and may be typically attached thereto by an integral hinge 33 and may be held in a closed position by a friction type latch 35 as will now be apparent to those skilled in the art.

Thus, the door member 31, when closed, coacts with the remainder of the inner cover means 27 to completely enclose the security box means 17 and completely insulate the security box means 17 from the electrically charged cover means 25. Likewise, the door member 32, when closed, coacts with the remainder of the outer cover means 29 to completely enclose the electrically charged cover means 25 and completely insulate the exterior thereof.

Electrically non-conductive sleeves 36 may be provided to electrically insulate the electrical supply and outlet lines 21, 23 as shown in FIG. 3. The sleeves 36 may be constructed out of any electrically non-conductive material such as plastic in any manner apparent to those skilled in the art. Thus, the sleeves 36 may be integrally constructed with one of the cover means 27, 29.

The electrically charged cover means 25 may be constructed of any electrically conductive material such as metal or the like. Preferably, the electrically charged cover means 25 includes a door member 37 for allowing authorized access to the door member 31 of the inner cover means 27. The door member 37 may be of any typical construction apparent to those skilled in the art. Thus, for example, the door member 37 may include two flap members 39 constructed of a substantially flexible electrically conductive material such as wire mesh with each flap member 39 integrally joined at one edge to the remainder of the electrically charged cover means 27 and positioned so that the other edge of each flap member 39 overlaps one another when the door member 37 is closed. Snap fasteners 41 may be provided to hold the flap members 39 in the closed, overlapped position. Thus, when the flap members 39 are in the closed, overlapped position, the electrically charged cover means 25 completely encloses the inner cover means 27 and the security box means 17. The electrical charge can be applied to the electrically charged cover means 25 in any manner apparent to those skilled in the art. Thus, for example, an electrically conductive line 43 may extend from any typical source 45 of electrical energy to the electrically charged cover means 25 whereby a positive electrical charge is applied to the electrically charged cover means 25 (see FIG. 3). If anyone then attempts an unauthorized entry into the security box means 17, a circuit will be completed between the source 45 of electrical energy, the person attempting the unauthorized entry, and the ground when that person contacts the electrically charged cover means 25. A remote switch means 47 is provided in the electrically conductive line 43 (see FIG. 3) to allow the electrically charged cover means 25 to be deactivated and to allow authorized entry into the security box means 17. The switch means 45 is preferably located at a remote, concealed or otherwise protected location.

Figure 4:
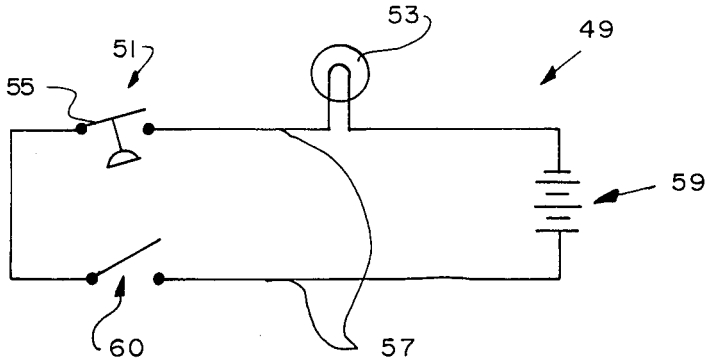
FIG. 4 is a schematic view of certain alarm circuitry of the present invention.
Figure 5:
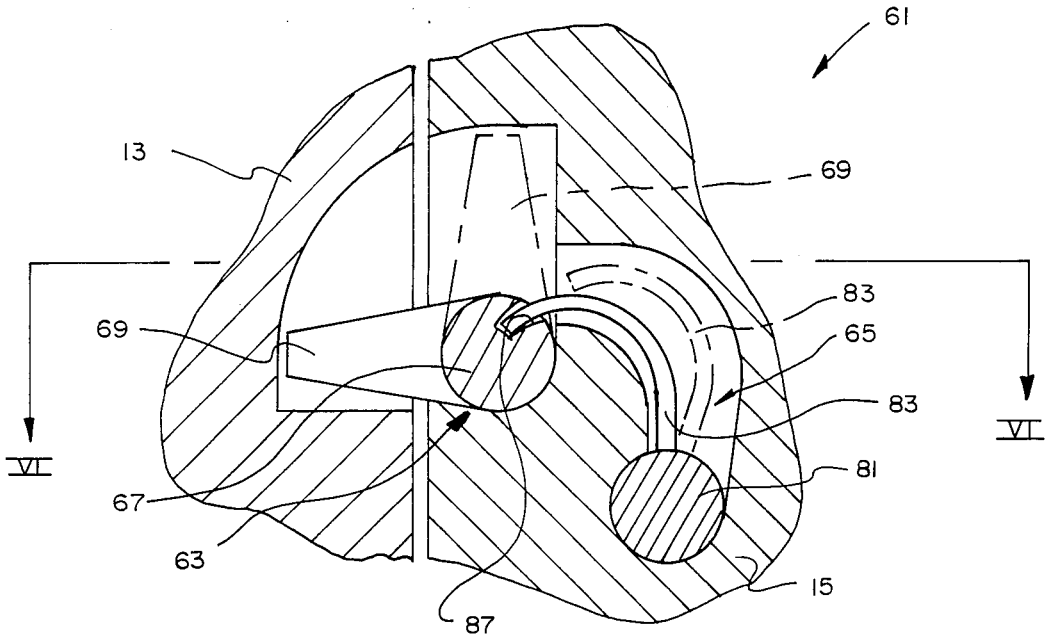
FIG. 5 is a sectional view showing the lock means of the protection means of the present invention.
Figure 6:
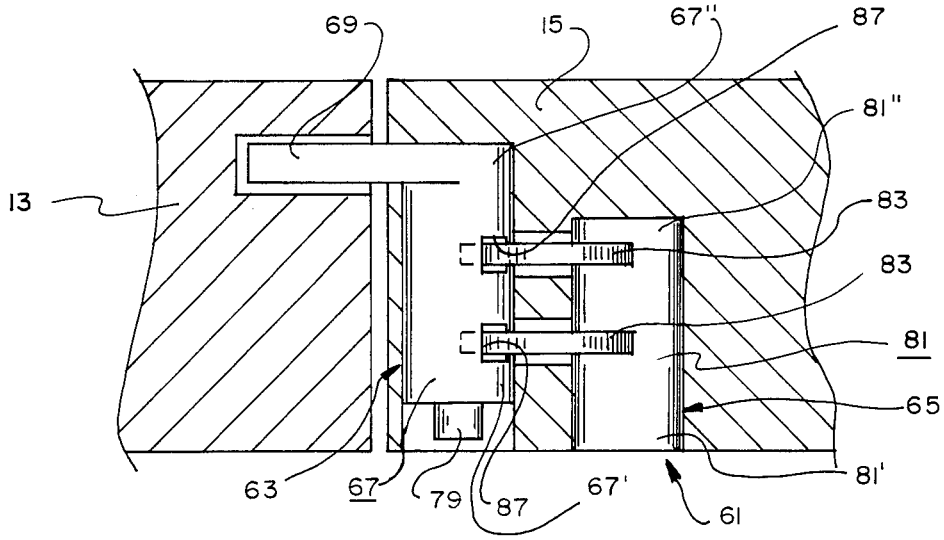
FIG. 6 is a sectional view substantially as taken on line VI—VI of FIG. 5.
Figure 7:
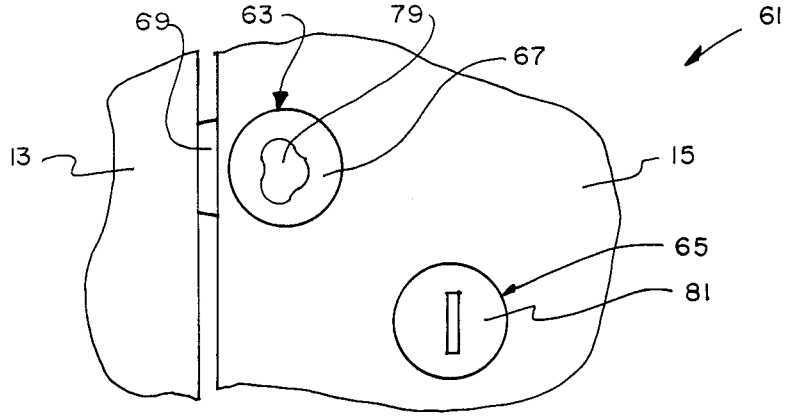
FIG. 7 is a front elevational view of the lock means shown in FIG. 5.

The protector means 11 preferably includes an alarm signal means 49 for producing an alarm signal and an alarm switch means 51 for activating the alarm signal means 49 when the outer cover means 29 is traversed without authorization (see FIG. 4). The alarm signal means 49 may consist of any well-known audible or non-audible alarm such as, for example, a light means 53. The alarm switch means 51 may consist of any typical switch means such as, for example, a pressure switch 55 that will close when the door member 32 is open or when the outer cover means 29 is otherwise traversed. Electrically conductive lines 57 connect a source of electrical energy such as a battery 59 to the light means 53 and pressure switch 55 so that the light means 53 will be activated when the pressure switch 55 is closed. A remote switch means 60 may be provided in the electrically conductive line 57 (see FIG. 4) to allow the alarm signal means 49 to be selectively deactivated. The switch means 60 is preferably located at a remote, concealed or otherwise protected location.

The protection means 11 may include a lock means 61 for locking the door member 13 of the security box means 17 in a closed position with respect to the door jamb 15 (see FIGS. 1, 3, 5 and 6). The lock means 61 includes a first lock means 63 movably mounted in the door jamb 15 for movement between a locked position as shown in solid lines in FIGS. 5 and 6 in which the door member 13 is locked in the closed position and an unlocked position as shown in broken lines in FIG. 5. The lock means 61 also includes a second lock means 65 movably mounted in the door jamb 15 for movement between a locked position as shown in solid lines in FIGS. 5 and 6 in which the first lock means 63 is locked in the locked position and an unlocked position as shown in broken lines in FIG. 5.

Figure 8:
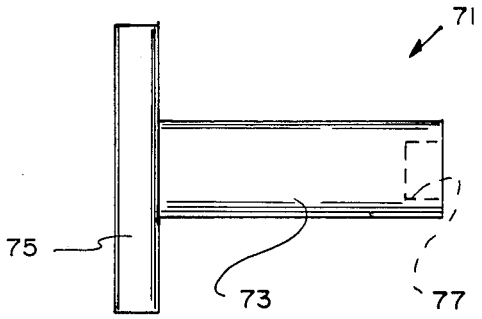
FIG. 8 is a front elevational view of a key means of the lock means.
Figure 9:
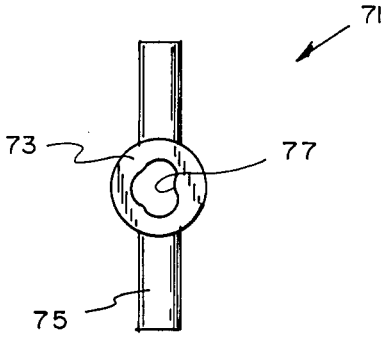
FIG. 9 is an end elevational view of the key means of FIG. 8.

The first lock means 63 preferably includes an elongated body member 67 rotatably mounted in the door jamb 15 and having first and second ends 67', 67'' respectively. The first lock means 63 also preferably includes a lug member 60 fixedly mounted on the second end 67'' of the body member 67 and extending outwardly thereof for lockably engaging the door member 13 when the first locked means 63 is in the locked position. A first lock key means 71 (see FIGS. 8 and 9) is provided for engaging the first end 67 of the body member 67 of the first lock means 63 and for moving the first lock means 63 between the locked and unlocked position. The first lock key means 71 may consist of an elongated body member 73 having a handle 75 at one end and having a uniquely shaped concavity 77 at the other end for mating with a uniquely shaped head 79 provided on the first end 67' of the body member 67 whereby the first lock key means 71 provides a unique means to operate the first lock means 63 as will be apparent to those skilled in the art.

Figure 10:
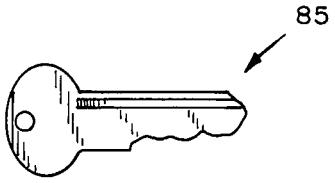
FIG. 10 is a front elevational view of another key means of the lock means.

The second lock means 65 preferably includes an elongated body member 81 rotatably mounted in the door jamb 15. The body member 81 has first and second ends 81', 81'' respectively. The second lock means 65 also preferably includes at least one arm member 83 fixedly mounted on the body member 81 and extending outwardly thereof for lockably engaging the body member 67 of the first lock means 63 when the first and second lock means 63, 65 are in the locked positions. A second lock key means 85 (see FIG. 10) is preferably provided for engaging the first end 81' of the body member 81 and for moving the second lock means 65 between the locked and unlocked positions. The body member 81 may consist simply of a typical key-type lock tumbler well-known to those skilled in the art for being rotated when a typical key is inserted therein. In such a case, the second lock key means 85 will consist of a typical key uniquely shaped so as to coact with the lock tumbler. The arm members 83 are preferably somewhat arcuate shaped and fixedly attached to the exterior of the body member 81 for being rotated with the body member 81. The body member 67 of the first lock means 63 preferably has one or more apertures 87 therein for receiving the ends of the arm members 83 when the first and second lock means 63, 67 are in the locked positions.

As thus constructed and used, the present invention provides a protection means for preventing or dissuading unauthorized access through a door member.

Although the invention has been described and illustrated with respect to preferred embodiments thereof and preferred uses therefore, it is not to be so limited since changes and modifications can be made therein which are within the full intended scope of the invention.

I claim:

1. A lock mechanism for preventing unauthorized entry through a door member of the type movably associated with a door jamb, said lock mechanism comprising:

(a) first lock means movably associated with said door jamb for movement between a locked position in which said door member is locked in a closed position and an unlocked position; said first lock means including a body member and including a lug member mounted relative to said body member thereof for extending between said door jamb and said door member when said first lock means is in said locked position, said first lock means having two cavities that are aligned along said body member thereof; and (b) second lock means movably associated with said first lock means for movement between a locked position in which said first lock means is locked in said locked position and an unlocked position; said second lock means including a body member and including two arms that are aligned along said body member thereof and that are fixedly mounted on said body member thereof and extending outwardly thereof for lockably engaging said body member of said first lock means by extending into respective ones of said cavities of said first lock means when said second lock means is in said locked position.

2. A lock mechanism for preventing unauthorized entry through a door member of the type movably associated with a door jamb, said lock mechanism comprising:

(a) first lock means movably associated with said door jamb for movement between a locked position in which said door member is locked in a closed position and an unlocked position; said first lock means including an elongated body member rotatably mounted in said door jamb and having first and second ends and including a lug member fixedly mounted on said second end of said body member thereof and extending outwardly thereof for lockably engaging said door member when said first lock means is in said locked position; said lug member extending into said door member when said first lock means is in said locked position; said first lock means having two cavities that are aligned along said body member of said first lock means;

(b) a first lock key means for engaging said first end of said body member of said first lock means and for moving said first lock means between said locked position and said unlocked position;

(c) second lock means movably associated with said door jamb for movement between a locked position in which said first lock means is locked in said locked position and an unlocked position; said second lock means including an elongated body member rotatably mounted in said door jamb and having first and second ends and including at least one arm member fixedly mounted on said body member thereof and extending outwardly thereof for lockably engaging said body member of said first lock means when said second lock means is in said locked position; said second lock means including two arcuate arms that are aligned along said body member of said second lock means; each of said arms of said second lock means extending into a respective one of said cavities of said first lock means when said second lock means is in said locked position; and (d) a second lock key means for engaging said first end of said body member of said second lock means and for moving said second lock means between said locked and unlocked positions.

* * * * *